United States Patent [19]

Pillow

[11] 4,446,929

[45] May 8, 1984

[54] FLUID OPERATED ROCK DRILL HAMMER

[75] Inventor: Dan L. Pillow, Garland, Tex.

[73] Assignee: Dresser Industries, Inc., Dallas, Tex.

[21] Appl. No.: 47,417

[22] Filed: Jun. 11, 1979

[51] Int. Cl.[3] ..... E21B 4/14; E21C 7/00

[52] U.S. Cl. ..... 173/17; 173/80; 173/136

[58] Field of Search ..... 173/17, 80, 136, 73

[56] References Cited

U.S. PATENT DOCUMENTS

| | | | |
|---|---|---|---|
| 3,084,673 | 4/1963 | Sears | 173/17 |
| 3,193,024 | 7/1965 | Cleary | 173/73 X |
| 3,527,239 | 9/1970 | Boom | 173/17 X |
| 3,599,730 | 8/1971 | Tyresco et al. | 173/17 |
| 3,606,930 | 9/1971 | Curington | 173/17 X |
| 3,612,191 | 10/1971 | Martini | 173/73 |
| 3,896,886 | 7/1975 | Roscoe, Jr. . | |
| 4,015,670 | 4/1977 | Rear . | |
| 4,133,393 | 1/1979 | Richards | 173/17 X |

FOREIGN PATENT DOCUMENTS

| | | | |
|---|---|---|---|
| 1004694 | 9/1965 | United Kingdom . | |
| 1419981 | 1/1976 | United Kingdom | 173/17 |
| 1552975 | 9/1979 | United Kingdom . | |

*Primary Examiner*—Robert Mackey

*Attorney, Agent, or Firm*—Fred A. Winans

[57] ABSTRACT

A fluid operated rock drill hammer includes an annular hammer body with the upper end of the hammer body adapted to be connected to a drill string and with a drill chuck mounted at the lower end of the hammer body. A drill bit extends through the drill chuck into the body. A piston is slidably mounted in the hammer body to move between the drill bit and the upper end of the hammer body for striking the portion of the drill bit that extends through the drill chuck. The force for moving the piston is provided by a fluid that is circulated through the drill string into the hammer body. A restricted exhaust port is provided for preventing back hammering of the piston by maintaining a high fluid pressure in the space between the piston and the upper end of the hammer body when the bit is off bottom.

1 Claim, 3 Drawing Figures

FLUID OPERATED ROCK DRILL HAMMER

BACKGROUND OF THE INVENTION

The present invention relates in general to the art of earth boring and, more particularly, to a down-the-hole fluid operated rock drill hammer. Fluid operated rock drill hammers generally include an annular body portion having a central chamber. A piston is mounted in the central chamber for axial movement to provide hammer blows. A bit is connected to the annular body for receiving the hammer blows. Fluid passage means are provided in the annular body and the piston for delivering driving fluid to move the piston and alternately strike the hammer blows and recover therefrom. In the prior art a phenomenon would occur known as "back hammering." Back hammering tended to occur in the prior art rock drill hammers when the hammer was off bottom because there was an absence of a positive force to maintain the piston in the lowermost position. Thus, when a hammer operation was to be discontinued, the drill pipe was raised allowing the bit to drop to its lowermost position. Under normal circumstances the piston should also drop to its lowermost position and remain there, however, because of inadequate design or because of fluid leakage due to wear, the piston would often tend to "float" above the bit. This would produce an unintended hammering action on the bit. This back hammering was very detrimental to the anvil and hammer surfaces and other elements of the rock drill hammer.

DESCRIPTION OF PRIOR ART

In U.S. Pat. No. 4,015,670 to Ian Graeme Rear, patented Apr. 5, 1977, a fluid operated hammer is shown. The fluid operated hammer for rock drills includes a cylinder, a drill chuck mounted at one end to receive a drill bit; a drill sub attached to the other end; a tubular fluid feed tube mounted in the drill sub and extending towards the chuck, the longitudinal central axis of the feed tube corresponding to the longitudinal central axis of the cylinder; at least one set of apertures provided in the side wall of the feed tube and spaced from each end; a piston reciprocally mounted in the cylinder and over the feed tube to move between the drill chuck and drill sub, the lower end being adapted for striking a portion of the drill bit extending through the drill chuck; a first passageway in said piston communicating with one end face thereof and opening into the center of the piston at a location spaced along the length of said piston; a second passageway in said piston communicating with the end face of the piston communicating with the end of the piston opposite to that of the first passageway and opening into the center of the piston at a location spaced along said piston, said first passageway communicating with one of said set of apertures in the feed tube when the piston is in abutting relationship with the chuck to admit fluid into the space between the piston and drill chuck to drive the piston upwards and said second passageway communicating with one of said set of apertures when the piston is at its upper position in the cylinder to admit fluid into the space between the piston and drill sub to drive the piston downwards.

In U.S. Pat. No. 3,896,886 to Theodore J. Roscoe, Jr., patented July 29, 1975, an air hammer embodying an outer housing structure connectable to a rotatable drill pipe string through which compressed air is conducted is shown. A hammer piston reciprocates in the housing structure, compressed air being directed alternately to the upper and lower ends of the piston to effect its reciprocation in the structure, each downward stroke inflicting an impact blow upon the anvil portion of an anvil bit extending upwardly within the lower portion of the housing structure. The flow of air to the upper and lower ends of the hammer piston is controlled by valve passages formed in the piston and a relatively stationary air supply tube which closes the passage to the lower end of the piston when the outer housing structure is lifted by the drill pipe string to allow the bit to hang down from the housing during the circulation of air for flushing cuttings from the borehole.

SUMMARY OF THE INVENTION

The present invention provides a fluid operated rock drill hammer having an annular hammer body. A drill chuck is mounted at the lower end of the hammer body. A drill bit extends through the drill chuck into the body. The upper end of the hammer body is connected to a drill string. A piston is mounted for reciprocal movement in the hammer body to move between the drill bit a higher position for striking hammer blows to the drill bit. A separate exhaust port having a restricted opening is provided for maintaining a higher pressure above the piston when the bit is off bottom and thereby preventing back hammering. The foregoing and other features and advantages of the present invention will become apparent from a consideration of the following detailed description when taken in conjunction with the drawings.

DETAILED DESCRIPTION OF THE INVENTION

Figure 1:
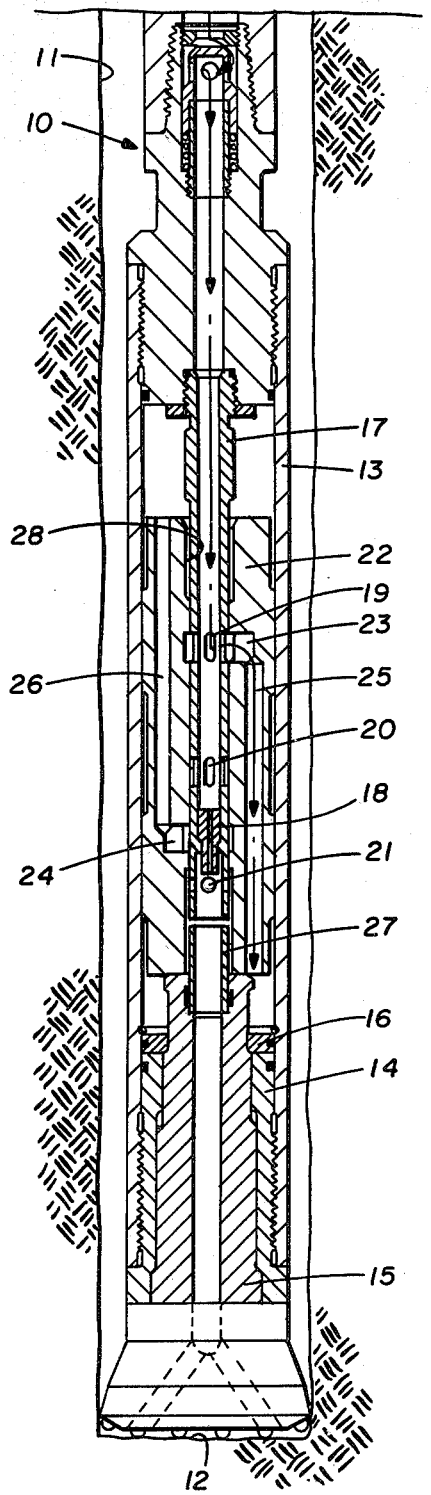
FIG. 1 illustrates a rock drill hammer with a sliding piston delivering a hammer blow to the drill bit.
Figure 2:
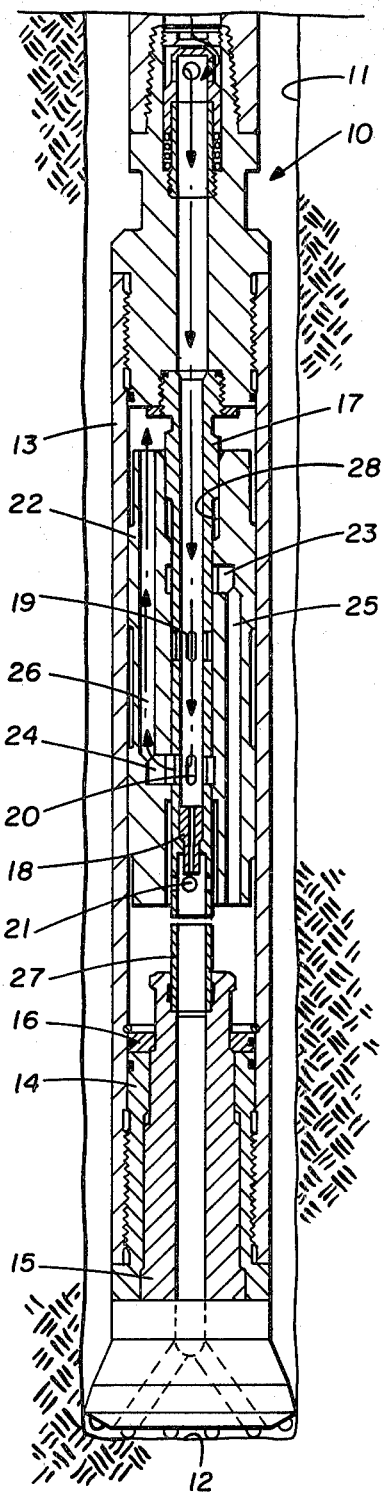
FIG. 2 illustrates the rock drill hammer with the sliding piston in the uppermost position.
Figure 3:
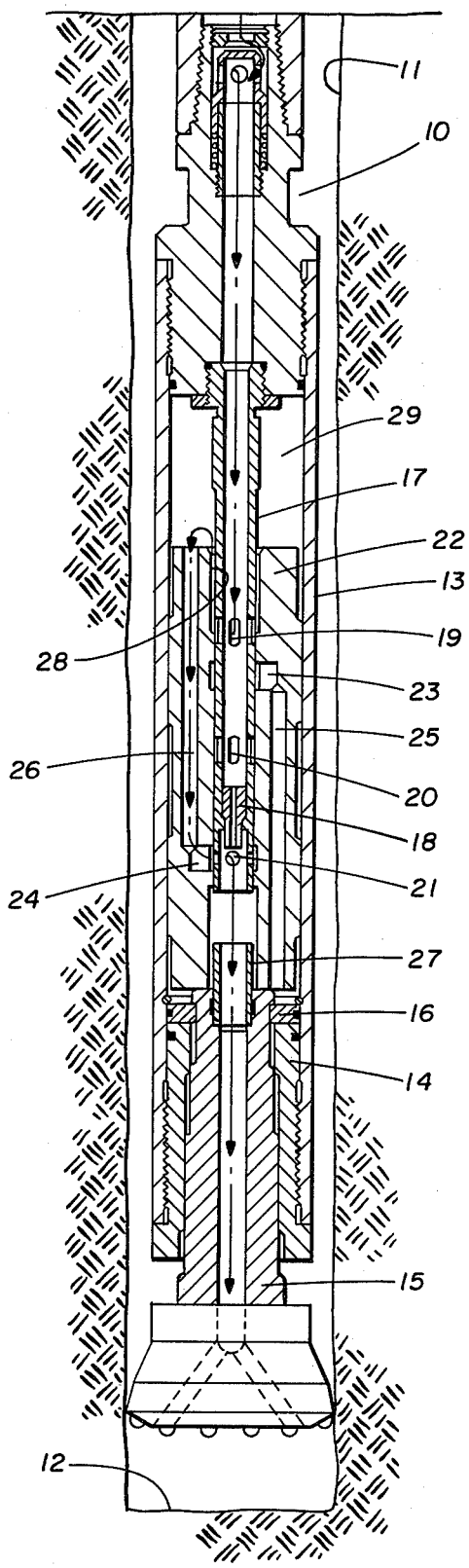
FIG. 3 illustrates the rock drill hammer with the drill bit off bottom.

Referring now to the drawings, a fluid operated rock drill hammer 10 is shown in three different stages of operation in FIGS. 1, 2 and 3. The hammer 10 is shown in an earth borehole 11. In FIGS. 1 and 2, the hammer 10 is on the bottom 12 of the borehole 11 and in position for drilling. In FIG. 3, the hammer 10 has been lifted off the bottom 12 of the borehole 11 and the drilling fluid is circulating through and out of the hammer 10.

The hammer 10 comprises a cylinder 13 with a drill chuck 14 at one end. The drill chuck 14 receives a drill bit 15. An exhaust tube 27 extends from the bit 15. The bit 15 is retained in the chuck 14 by retaining ring 16. When bit 15 is in the cylinder 13 there is a limited amount of longitudinal movement provided between the bit 15 and chuck 14. The cylinder 13 is connected by its upper end to a drill string (not shown). A compressed air supply is transmitted down the drill string.

A feed tube 17 is mounted in the cylinder 13. The feed tube 17 extends from the upper end of the cylinder 13 toward the chuck 14 but terminates just above the drill bit 15. The longitudinal central axis of the feed tube 17 corresponds with the longitudinal central axis of the cylinder 13. The feed tube 17 is restricted by a reduced diameter plug 18 that reduces the fluid flow through the feed tube 17. A set of restricted orifices 21 are located at the lower end of feed tube 17 below the plug 18 for a purpose to be explained below. An upper set of apertures 19 and a lower set of apertures 20 are provided in the wall of the feed tube 17. The sets of apertures 19 and 20 include four individual apertures spaced circumferentially around the feed tube 17.

An annular piston 22 is slidably mounted in the cylinder 13 to move between the drill bit 15 and the upper end of the cylinder 13. The piston 22 has two spaced diametric grooved apertures 23 and 24 extending around the piston wall. Each aperture 23 and 24 has communication with longitudinal passageways 25 and 26, respectively, which provide fluid communication with lower surface and upper surface of the piston 22. The passageway 25 is connected to the end face surface at the lower end of piston 22 and passageway 26 is connected to the end face surface at the upper end of piston 22.

The structural elements of a rock drill hammer 10 constructed in accordance with the present invention having been described, the operation of the hammer 10 will now be considered. FIG. 1 illustrates the piston 22 at its lowermost position in contact with the drill bit 15. The upper end of the drill bit 15 is provided with an anvil surface that is struck by the hammer surface on the lower end face of piston 22. The hammer force is transmitted through the bit 15 to the formations at the bottom 12 of the borehole 11 thereby fracturing the formations and extending the borehole into the earth.

Prior to the hammer blow being imparted to the bit 15, the piston must be moved upward to the position shown in FIG. 2. When the piston is in its lowermost position as shown in FIG. 1, the uppermost set of diametric apertures 23 in the piston 22 are adjacent the uppermost set of apertures 19 in the feed tube 17. High pressure air is forced into the sealed space between (A) the lower surface of the piston 22 and (B) the drill bit 15 and the exhaust tube 27 to drive the piston 22 upward. Air trapped by upward movement of the upper end of the piston 22 is compressed between the upper surface of the piston 22 and the upper portion of the cylinder 13. This provides a cushioning effect to retard the further upward movement of the piston 22.

When the piston is at its uppermost position as shown in FIG. 2, the lowermost set of apertures 24 in the piston 122 is adjacent the lowermost set of apertures 20 in the feed tube 17. This provides fluid communication with the sealed volume above the upper end of the piston 22. The upper set of diametric apertures 23 are blocked by the feed tube 17. As a result, high pressure air is admitted to the volume above the piston 22 to drive the piston 22 down the cylinder 13 and onto the drill bit 15 to provide the desired hammer blow.

In order to cease hammering, the drill string is raised to permit the drill bit 15 to drop in the chuck 14 to its lowermost position as shown in FIG. 3. The bit 15 is then supported by the retaining ring 16. As a result of the bit 15 being lower in the cylinder 13 than during the hammering operation, the piston 22 abuts the drill bit 15 and the upper set of apertures 23 in he piston are blocked by the feed tube 17 to prevent any air flow into the space below the lower end of the piston 22. The piston 22 remains in its lowermost position without the hammering action previously described. The circulating air is allowed to travel through the hammer 10. The enlarged bore portion 28 surrounding feed tube 17 at the upper end of the piston 22 is located adjacent the upper set of apertures 19 on the feed tube 17. As a result, air from the apertures 19 flows into the space defined above the upper end of the piston 22, down the passageway 26 through the lower set of apertues 24 through the restricted orifices 21, maintaining a high pressure in this upper chamber, and out of the drill bit 15. Thus by raising the drill string and permitting the drill bit 15 to drop in the chuck 14 not only is the hammer deactivated but also the flow of air through the bit 15 is maintained to clear cuttings from the area of the bit 15 at the bottom 12 of the borehole 11.

The restricted orifices 21, used to exhaust pressurized fluid only when the bit is off bottom, produce a pressure buildup in the chamber 29 between the upper end face or upper surface of piston 22 and the upper end of the cylinder 13. The increased pressure in chamber 29 provides a positive force that maintains the piston 22 in the lowermost position against the bit 15. This prevents the phenomenon known as "back hammering". Back hammering tended to occur in the prior art rock drill hammers because there was an absence of force to maintain the piston in the lowermost position. The piston would tend to "float" near the bit 15 and produce an unintended hammering action on the bit 15. This back hammering was very detrimental to the anvil and hammer surfaces and other elements of the hammer. An additional advantage of maintaining a higher pressure in the chamber 29 is that material in the borehole is excluded from the interior of the cylinder 13. The higher pressure in chamber 29 prevents cuttings and drilling debris from migrating into the cylinder from the borehole that may otherwise be ingested thereinto if such higher pressure were not present.

I claim:

1. A fluid operated rock drill hammer, comprising:

an annular body having an upper end and a lower end;

a drill chuck mounted at the lower end of said body;

a drill bit connected to said drill chuck and extending into said body, said drill bit moveable in said drill chuck from a drilling position to a bypass position;

a tubular fluid feed tube mounted in said body and extending from said upper end toward the drill chuck;

a first set of apertures in said feed tube;

a second set of apertures in said feed tube;

a piston slidably mounted in said body positioned around said feed tube to move between the drill bit at the lower end for striking the drill bit and the upper end of said body, said piston having an upper surface and a lower surface;

a first passageway in said piston communicating from the lower surface of the piston to said first set of apertures in the feed tube when the piston is in abutting relationship with the drill bit and the drill bit is in drilling position to admit fluid into the space between the piston and drill bit to drive the piston upward;

a second passageway in said piston communicating from the upper surface of the piston to said second set of apertures in said feed tube when the piston is at its upper position in the body to admit fluid between the piston and the upper end of the body to drive the piston downward; and a separate fluid passage in said piston providing fluid communication between said first set of apertures and said upper surface of said piston when said piston is abutting said drill bit in a by-pass position to provide pressurized fluid to said upper surface; and a separate restricted exhaust opening in said tube and said second passageway providing fluid communication between the upper surface of said piston and said restricted opening when said drill bit is in said by-pass position to restrict exhaust of pressurized fluid from adjacent said upper surface and thereby maintain a higher pressure on said upper surface.

* * * * *